US006148617A

United States Patent [19]

Williams

[11] Patent Number: 6,148,617

[45] Date of Patent: Nov. 21, 2000

[54] NATURAL GAS FIRED COMBUSTION SYSTEM FOR GAS TURBINE ENGINES

[75] Inventor: Samuel B. Williams, Bloomfield Hills, Mich.

[73] Assignee: Williams International, Co. L.L.C., Walled Lake, Mich.

[21] Appl. No.: 09/110,538

[22] Filed: Jul. 6, 1998

[51] Int. Cl.[7] ..... F02C 1/00

[52] U.S. Cl. ..... 60/737; 60/760

[58] Field of Search ..... 60/39.36, 39.465, 60/734, 737, 740, 745, 760

[56] References Cited

U.S. PATENT DOCUMENTS 3,115,011 12/1963 Deinhardt et al. ..... 60/760

4,232,526 11/1980 Barbeau ..... 60/745

5,323,602 6/1994 Defever ..... 60/39.36

FOREIGN PATENT DOCUMENTS 1219287 6/1966 Germany ..... 60/39.36

*Primary Examiner*—Charles G. Freay

*Attorney, Agent, or Firm*—Lyon, P.C.

[57] ABSTRACT

A fuel-air distribution manifold for a gas turbine engine having an annular combustor surrounds the shaft of the engine and comprises a gas distribution annulus surrounding an air distribution annulus having a plurality of fuel-air mixing channels radially aligned with nozzles on the gas annulus, respectively, and communicating with the engine combustor. A fuel duct conducts a gaseous fuel only to the gas distribution annulus and an air duct conducts air only to the air annulus.

5 Claims, 1 Drawing Sheet

NATURAL GAS FIRED COMBUSTION SYSTEM FOR GAS TURBINE ENGINES

BACKGROUND OF THE INVENTION

This invention relates generally to a system for introducing natural gas or other gaseous fuel into a gas turbine engine combustor and more particularly to a system that provides a well distributed relatively "lean" mixture of gas and air to the combustor of a gas turbine engine so as to minimize undesirable exhaust emissions. A gas turbine using the system of the invention exhibits very low levels of nitrogen oxide, unburned hydrocarbon and carbon monoxide.

It is well known that oxides of nitrogen form rapidly if high temperatures are reached in the combustion process. Moreover, the level of nitrogen oxide increases as a function of time if the high temperature is maintained. However, the level of nitrogen oxide can be reduced by the entry of dilution air. It is also known to reduce the level of pollutants by reducing the air-fuel ratio to a "lean pre-mixed" fuel-air ratio prior to combustion.

SUMMARY OF THE INVENTION

The present invention relates to a novel configuration that achieves a "lean pre-mixed" fuel-air mixture while not overheating the structural components of the system. Mixing of the fuel and air is achieved over a relatively large area that results in a uniform outlet temperature from a combustor as opposed to localized hot areas and resultant structural degradation.

The present invention has particular application to natural gas fired turboshaft engines utilized in, turbine generators, and hybrid electric vehicle propulsion systems. The system effects injection of a gaseous fuel, for example, natural gas, into the combustor of a turbine engine so as to obtain a lean mixture of fuel and air prior to the initiation of combustion thereby to minimize the formation of oxides of nitrogen. The invention also contemplates an injection system sized to produce one or more relatively rich zones to maintain combustion during reduced temperature operation as experienced in low power operation. This feature is especially valuable in regenerated or recuperated engines which may require very lean operation during and immediately after a sharp reduction in load. The disclosed system comprises an annular non-rotating dual chamber manifold disposed radially outwardly of the turbine shaft but radially inwardly of the engine combustor. The manifold extends axially from the front of the combustor to the rear thereof so as to isolate the turbine shaft from the combustor zone. As a result, major sealing is only required to isolate compressor back-wall pressure from the area downstream of the high pressure turbine nozzle.

DETAILED DESCRIPTION OF THE PREFERRED EMBODIMENT(S)

Figure 1:
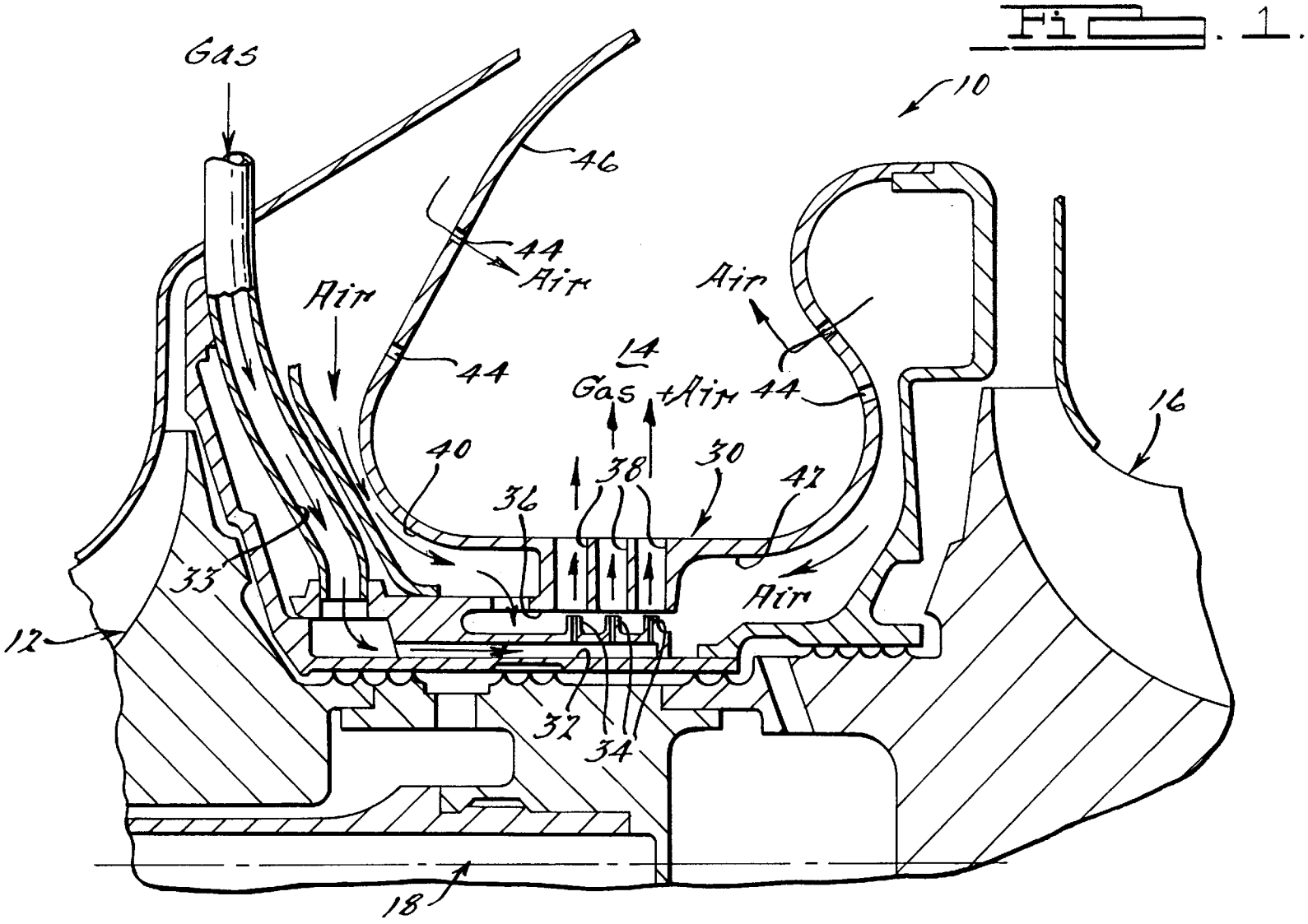
FIG. 1 is a cross sectional elevation of the natural gas fired combustion system in accordance with the present invention.

As seen in the drawing a gas turbine engine 10 comprises a conventional compressor 12, annular combustor 14 and high pressure turbine 16. A shaft assembly 18 transmits rotation from the turbine 16 to the compressor 12 and to output machinery (not shown).

In accordance with the present invention, an annular air-fuel distribution manifold 30 surrounds the engine shaft assembly 18. The manifold 30 comprises a natural gas distribution annulus 32 that is fed by a gas duct 33. The gas annulus 32 is provided with a multiplicity of radially extending nozzles 34 through which the gas flows to an air distribution annulus 36 at relatively high velocity. The nozzles 34 are distributed circumferentially about the gas annulus 32 to provide broadly distributed gas flow into the air annulus 36.

The air annulus 36 of the manifold 30 is provided with a plurality of radially extending air ducts 38, one of which is radially aligned with each gas nozzle 34. Air enters at both longitudinally spaced ends of the air annulus 36 of the manifold 30 from ducts 40 and 42, thence flows around the protruding gas nozzles 34, and then radially outwardly through the air ducts 38 into the combustor 14 of the engine 10. The gas and air commence mixing immediately upon exit of the gas from the nozzles 34. The circumferentially distributed mixing process of the gas and air results in uniform, broadly spread out combustion in the combustor 14. Additional air for combustion and/or dilution may be injected through apertures 44 in the walls 46 of the combustor 14. It is to be noted that the flow rate of air and fuel can be adjusted at any given location by sizing of the nozzles 34 to provide a local relatively rich mixture to serve as a flame holder to avoid "lean blowout".

I claim:

1. In a gas turbine engine comprising an air compressor, a high pressure turbine, a rotatable shaft driven by said turbine for driving said air compressor, a gaseous fuel combustion system comprising:

an annular fuel-air distribution manifold surrounding the shaft of said engine in radially outwardly spaced relation thereto, said fuel air distribution manifold comprising a gas distribution annulus adjacent the shaft of said engine having a plurality of gas ejection nozzles extending radially outwardly from a radially outer wall thereof, and an air distribution annulus surrounding said gas annulus in radially outwardly spaced relation thereto, said air annulus of the fuel-air distribution manifold having a radially outer wall with a plurality of radially opening fuel-air mixing channels therein radially aligned with the nozzles on the gas annulus of said fuel-air manifold, respectively;

an annular combuster surrounding said fuel-air distribution manifold in radially outwardly spaced relation thereto;

a fuel duct for conducting a gaseous fuel to the gas annulus of said fuel-air manifold;

an air duct for conducting compressed air from said air compressor to the air annulus of said fuel-air manifold and to plurality of apertures in a wall of said combustor, each aperture respectively spaced radially outwardly from the air-fuel mixing channels in said fuel-air distribution's manifold, whereby the gaseous fuel and air are mixed in the fuel-air mixing channels and air only is injected into the combustor radially outwardly from said fuel-air mixing channels so as to produce a lean fuel-air mixture in said combustor radially outwardly from the fuel-air mixing channels.

2. The combustion system of claim 1 wherein mixing of the fuel and air is initiated in said fuel-air distribution manifold externally of the combustor of said engine.

3. The combustion system of claim 1 wherein said air-fuel manifold extends between the combustor and shaft of the engine so as to isolate the shaft from heat generated in said combustor.

4. The combustion system of claim 1 wherein said gas ejection nozzles form a radially outer wall of said gas distribution annulus and a radially inner wall of said air distribution annulus.

5. The combustion system of claim 1 wherein said mixing channels form a radially inner wall of said combustor and a radially outer wall of the air distribution annulus of said fuel-air manifold.

* * * * *